US011130602B1

(12) United States Patent
Beall

(10) Patent No.: US 11,130,602 B1
(45) Date of Patent: Sep. 28, 2021

(54) PACKING APPARATUS

(71) Applicant: William Gary Beall, Saint Simons Island, GA (US)

(72) Inventor: William Gary Beall, Saint Simons Island, GA (US)

( * ) Notice: Subject to any disclaimer, the term of this patent is extended or adjusted under 35 U.S.C. 154(b) by 216 days.

(21) Appl. No.: 15/978,404

(22) Filed: May 14, 2018

Related U.S. Application Data

(60) Provisional application No. 62/511,392, filed on May 26, 2017.

(51) Int. Cl.
*B65B 35/10* (2006.01)
*B65B 59/02* (2006.01)
*B65B 5/06* (2006.01)

(52) U.S. Cl.
CPC ..... *B65B 35/10* (2013.01); *B65B 5/06* (2013.01); *B65B 59/02* (2013.01)

(58) Field of Classification Search
CPC ..... B65B 35/00; B65B 35/10; B65B 35/12; B65B 35/24; B65B 35/243; B65B 5/00; B65B 5/04; B65B 5/10; B65B 59/00; B65B 59/005; B65B 59/02
USPC ..... 53/473, 475, 452, 458
See application file for complete search history.

(56) References Cited

U.S. PATENT DOCUMENTS 5,239,809 A * 8/1993 Long ..... B65B 35/243 198/626.6
5,345,748 A * 9/1994 Powell, Jr. ..... G01G 13/248 53/244
5,588,284 A * 12/1996 Klover ..... B65B 21/16 53/249

* cited by examiner

*Primary Examiner* — Chelsea E Stinson
(74) *Attorney, Agent, or Firm* — Jonathan Rigdon Smith; Jonathan R. Smith

(57) ABSTRACT

A tilt-able flat table, mounted on cams in a frame, retrieves rows of containers from a stage and deposits them in a box. The table is mounted on a horizontal tilt axle which is borne between two parallel cams. The tilt angle determines the path of the containers into the box. The cams rotate about a cam axis which determines the position of the table relative to the frame. Container top bands engage the containers on the table and move them in the forward-rearward direction on the table. The frame is movable relative to the box.

6 Claims, 2 Drawing Sheets

PACKING APPARATUS

CROSS-REFERENCES TO RELATED APPLICATIONS

This nonprovisional application for patent claims priority to U.S. provisional patent application No. 62/511,392, filed May 26, 2017.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

REFERENCE TO A BIOLOGICAL SEQUENCE LISTING

Not applicable.

BACKGROUND OF INVENTION

Field of the Invention

This invention is in the field of package making, more specifically in the field of packing boxes or cartons with articles, and still more specifically in the field of stacking layers of articles within a box or carton.

Description of the Related Art

In the fruit and vegetable packing industry, rectangular "clamshell" packages are filled with tomatoes, berries, and the like, and closed for further packing and distribution. Clamshells are plastic five-sided boxes with a lid live-hinged to one edge. Once filled and closed, the clamshells are then arranged into rectangular groups which are pushed or lowered into a box. Often it is desirable to place more than one layer of groups into a box before the box is sealed for delivery.

Because individual vegetable containers are rectangular and have straight rigid edges and corners, and because clamshell containers in particular have protruding edges, it can be difficult to arrange a group of them in a box using automatic packaging equipment, especially if it is necessary to place such groups in layers within a box. This is because the edges may "hang" on each other, preventing the layers from being placed in the box evenly on the first or subsequent layers. Sometimes individual clamshells may pop open. As a result, it is necessary to have inspectors at the ready to stop the packaging line when misalignment occurs and manually rearrange the containers. They must see that the containers are still sealed, verify that the proper number of containers are in each box, and assure that the box can be closed.

One existing clamshell loading apparatus has a conveyor load an array of clamshells onto a stage, from which they are pushed onto a curved trough. The trough is lowered into a box and tipped to dump the clamshells into the box. This device is observed to cause the clamshells to hang. In addition, the trough has to be changed whenever the length of the box changes. This is a time-consuming manual process. This and other container loading systems require precise pre-positioning of the clamshell conveyor up to the stage, and precise pre-positioning of the trough relative to the stage and the box.

BRIEF DESCRIPTION OF THE INVENTION

Objects of the Invention

The object of this invention is to reduce or eliminate the hanging of container edges as they are placed into the box. Another object of the invention is to avoid having to change parts when the length of the box is changed. Yet another object of the invention is to allow placing less than a complete array of containers in a given layer within the box. A further object of the invention is to permit retrieval of containers from a stage or conveyor that is not precisely positioned relative to the box. Another object of the invention is to increase the speed or rate of this machine compared to previous designs by, inter alia, reducing the time required for intervention by a quality control person to correct packaging mistakes, removing the step of having to change parts when a box of different length is needed, and in embodiments, removing the need for sweeping the containers into the apparatus.

SUMMARY OF THE INVENTION

The instant invention is a tilt-able flat table, mounted on cams in a frame, that receives or retrieves one or more rows of containers from a conveyor or stage and deposits them in a box. The table is mounted on a horizontal tilt axle which is borne between two parallel cams. The tilt angle determines the vertical path of the containers into the box. The cams rotate about a cam axis which is parallel to the tilt axle and determines the height and forward-rearward position of the table relative to the frame. Container top bands engage the containers on the table and move them in the forward-rearward direction on the table. The frame is movable in the forward-rearward direction relative to the box, and may be set up to position itself relative to surrounding equipment such as stages and conveyors. These and other benefits will become more clearly illustrated in the following detailed description and drawings.

DETAILED DESCRIPTION OF THE INVENTION

Figure 1:
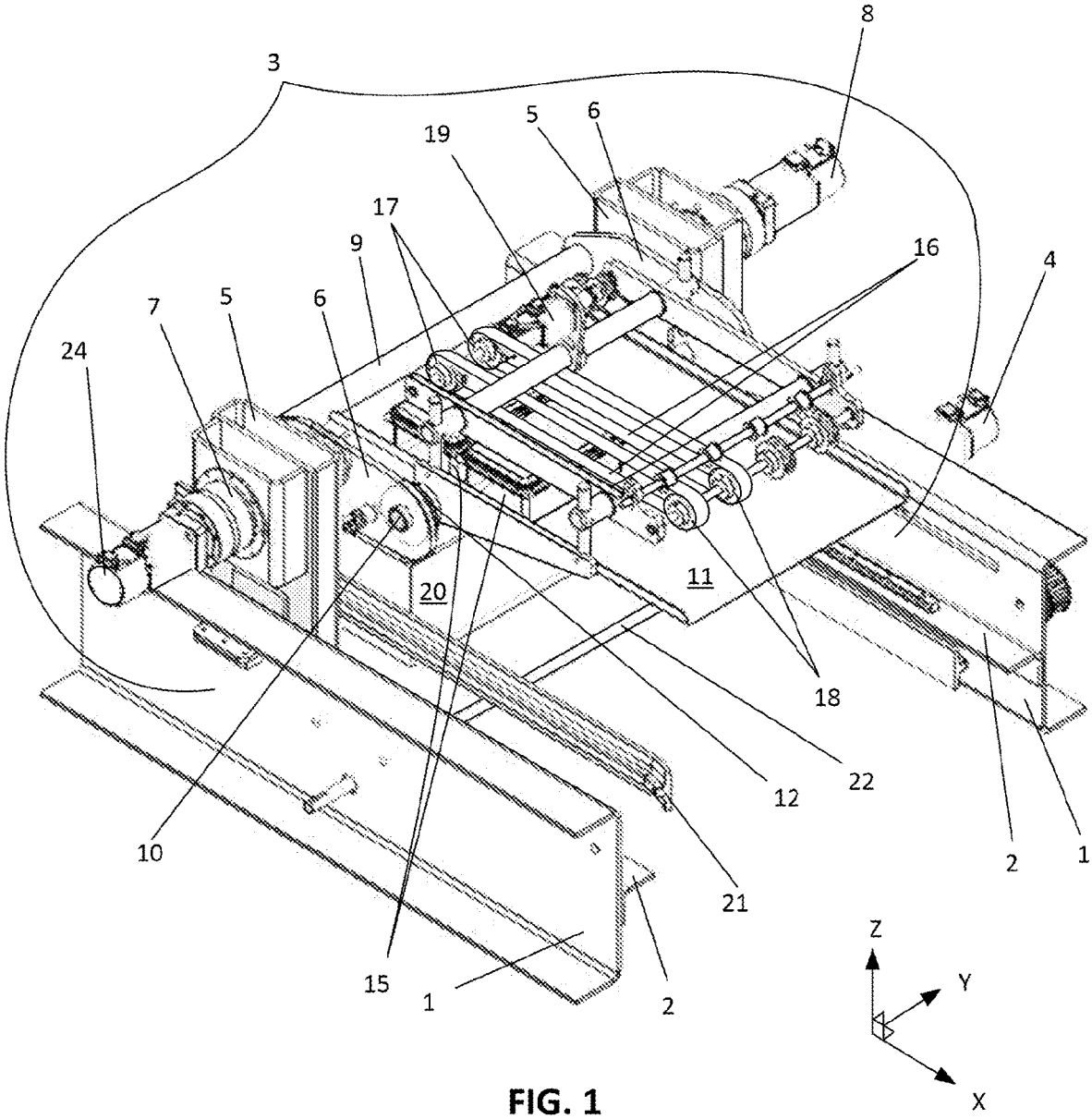
FIG. 1 is an isometric view of the present invention.

Referring now to the drawings, in which like reference characters refer to like elements among the drawings, FIG. 1 is an isometric view of a first embodiment of the present invention from above its right front. It is mounted on two facing channels 1. Each channel has a inwardly-placed lip 2, the two of which support a frame 3 that may be moved in the X-axis direction by a frame motor 4. Equivalent means of supporting a frame for motion in the X-axis direction are included in this invention without limitation.

The frame 3 has two vertical support blocks 5, each of which supports a cam 6 which is rotatable on a horizontal cam axle 7 which extends in the Y-axis direction. Each block 5 rides forward and rearward on a lip 2, driven by the frame motor 4 and frame axle 22. Both cams 6 are rotatable in an X-Z plane about the cam axle 7 by a cam motor 8. The cams 6 are joined by a cam rod 9, so that the cam motor 8 moves both cams in concert. Each cam 6 has a table axle 10 parallel to, but offset from, the cam axle 7. The table axles are collinear and support a flat table 11. The table 11 can rotate about the table axles through any angle in the X-Z plane, and is positioned by a table gear or sprocket 12 driven by a belt or chain (not shown) connected to a tilt motor 24.

By way of example and not limitation, two clamshell containers 15 are shown on top of the table 11. The containers are held against the table by four container top bands 16 (only two of which are shown in this view for clarity) which ride on four rear idlers 17 and four front idlers 18. The container top bands 16 are flexible obround bands having a lower surface which presses against the tops of the containers 15 to move them back and forth on the table 11. Other means of traction against the tops of the containers 15 such as strips or chains may be substituted for the bands so long as the friction between them and the tops of the containers is greater than the friction between the containers and the table. The rear idlers 17 are driven in either direction by an idler motor 19, moving the container top bands either forward or rearward in the X direction accordingly. A box 20 is shown underneath the frame 3, into which the containers 15 are to be placed. The box 20 is independently positioned for loading with containers between the rail 21 and a like rail opposite to it.

Figure 2:
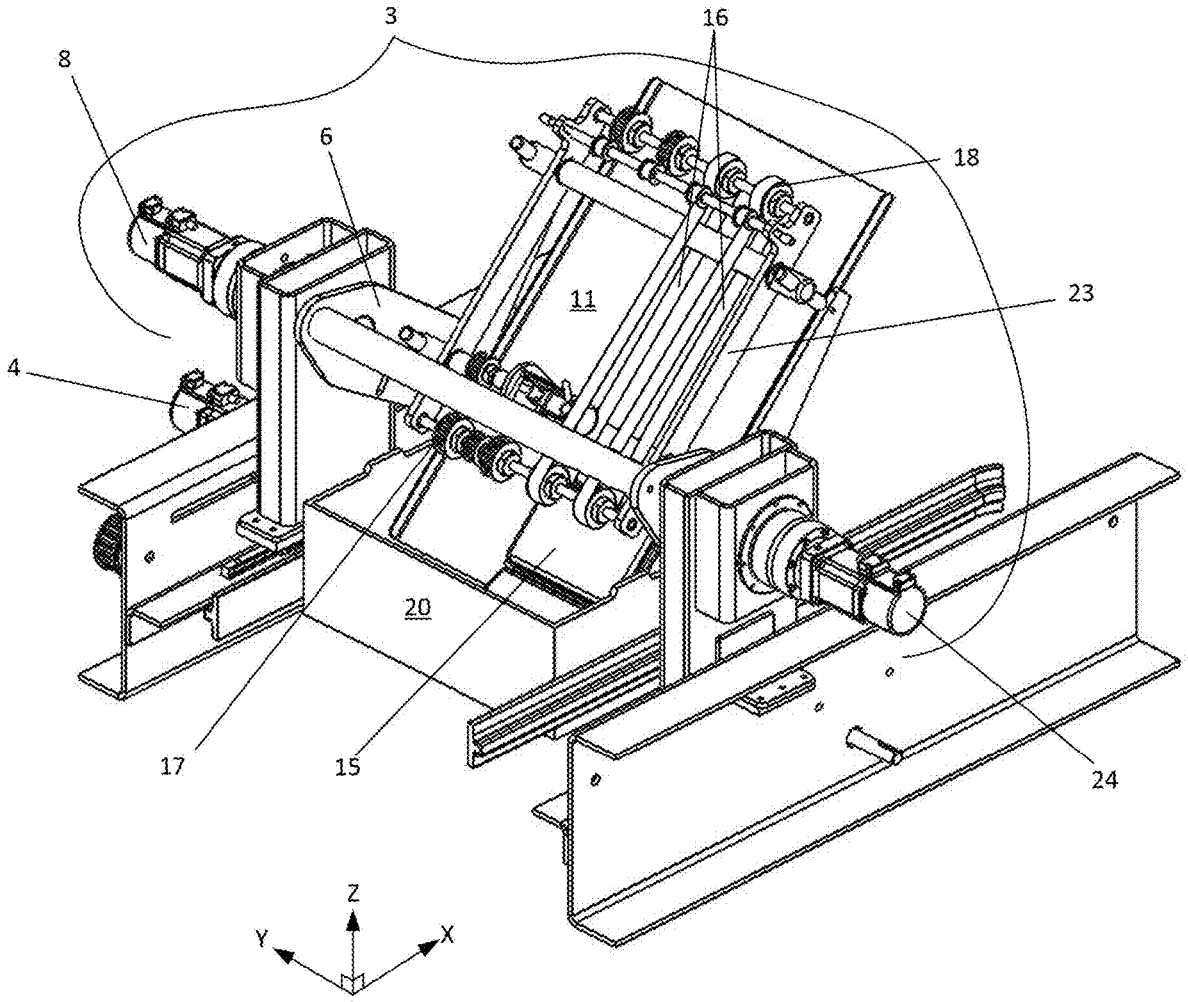
FIG. 2 is another isometric view of the present invention.

FIG. 2 is an isometric view of the present invention from the right rear. It shows the table 11 in position to dump the containers 15 into the box 20. (Only two containers are shown here, but for a box 20 of the width shown, two other containers would exist to the left of those shown.) The cam motor 8, operating under direction of a programmable logic controller (PLC) (not shown) has rotated the cams 6 about 45 degrees clockwise in this view. The table 11, also operated by the PLC, has been rotated by the tilt motor 24 about 90 degrees counterclockwise relative to the cams. The rear idlers 17 have likewise been rotated clockwise in this view a sufficient number of turns to push the containers 15 downward into the box 20. During this process, the frame motor 4 has been positioning the frame 3 above the box 20 so as to lay the containers 15 down into the box where they belong. All of these movements are coordinated by the PLC to position the containers in the box so that they do not snag each other or the box.

As the PLC continues to function, the cams 6 will rotate slightly counterclockwise and the table 11 will continue to rotate counterclockwise until the table is nearly vertical at the front end of the box 20 (toward the right rear in this view). As it goes, the containers 15 will drop into the box forming a first tier of containers on the bottom of the box. At that point in time, the cams will continue to rotate counterclockwise and the table will simultaneously rotate slightly clockwise relative to the cams, maintaining the table in a vertical attitude until the rear end of the table is clear of the tops of the containers. Once the rear table edge is clear of the containers, the cams will continue to rotate counterclockwise until they are approximately level, and the table will continue to rotate clockwise until it too is approximately level. FIGS. 1 and 2 show the apparatus in two discreet positions, but the transitions between these positions and beyond them are continuous under PL-control for smooth placement of the containers within the box. The combination of the two rotational cam motors 8, 24, the linear frame motor 4, and the box conveyor motor (idler motor 19) with PLC control and stored programs allows an infinite and subtle control of the angle, position and speed that the clamshell container 15 enters the box 20. This control is what makes it possible to place clamshells in the box in the correct position and orientation (clamshells not tilted relative to each other or the box) and allows for changing clamshell size by using preprogrammed routines that store the pattern that the mechanism uses to load the box with clamshells.

A second tier of containers (not shown) will then be pushed or swept towards the front idlers 18 from an adjacent stage or conveyor (not shown) until they are engaged by the container top bands 16 (only two of four are shown for clarity) and pulled onto the table. Alternatively, the entire frame 3 can be moved to the right in this view (along the X axis) by the PLC to engage a new tier of containers.

The depicted embodiment shows the front and rear idlers, 18 and 17 respectively, mounted an equal distance above the table 11 and held by a manually-adjustable rack 23. The rack is adjustable to position the top bands 16 (only two of which are shown for clarity) farther above or closer to the table to accommodate containers of different heights. In another embodiment, the rack 23 is raised and lowered by another PL-controlled motor to automate that function. In yet another embodiment, the rack is driven forward or backward relative to the table and pivoted near the rear idlers so as to raise the front idlers in the X-Z plane and advance them towards and above a tier of containers. The rack is then pivoted in the opposite direction and retracted forward or backward, as the case may be, to pull the tier of containers onto the table. This function obviates the need to push or sweep the containers onto the table 11. These additional motions can be accomplished by one or more additional PL-controlled motors or by mechanical linkages as appropriate.

Other means of positioning the frame 3, box 20, table 11, rack 23, and bands 16 in a coordinated fashion to load containers into a box using movements described above, such as, but not limited to, mechanical linkages operated by a different number of motors or by wired or wireless digital controls, or combinations of such, are included in this invention without limitation. Individual containers with shapes other than clamshells are within the scope of this invention without limitation.

I claim:

1. A packaging apparatus, comprising:

a frame movable forwardly and rearwardly in a horizontal X direction;

means for moving said frame being a frame motor;

at least one cam rotatably attached to said frame on at least one cam axle extending in said Y direction at right angles to said X direction;

means for rotating said at least one cam being a cam motor;

a flat table fixed to at least one table tilt axle parallel to said at least one cam axle;

means for rotating said table about said at least one table tilt axle in an X-Z plane;

a rack comprising at least one band movable forwardly and rearwardly;

said means for rotating said table being a tilt motor;

means for adjusting the distance between said rack and said table;

said means for adjusting said distance being either:

(1) a raising and lowering motor; or (2) a manual adjustment;

means for moving said at least one band forwardly and rearwardly; and means for moving said at least one band being an idler motor.

2. The apparatus of claim 1, in which:

said rack is pivotable in an X-Z plane and movable forwardly and rearwardly relative to said frame; and further comprises a means for pivoting and moving said rack.

3. The apparatus of claim 1, further comprising:

a movable frame mount;

a means for moving the frame mount;

said rack being rotatable in an X-Z plane and movable forwardly and rearwardly relative to said frame; and a means for pivoting and moving said rack.

4. The apparatus of claim 3, wherein:

said means for moving the frame mount is either:

(a) a mount motor; or (b) manual positioning of the mount;

said means for moving the frame is a frame motor;

said means for rotating the at least one cam is a cam motor;

said means for rotating the table is a tilt motor;

said means for adjusting said distance is either:

(a) a raising and lowering motor; or (b) a manual adjustment;

said means for moving said at least one band is an idler motor; and said means for pivoting and moving said rack is a rack motor.

5. The apparatus of claim 4, in which:

at least one PLC controls either:

(a) said mount motor;

(b) said frame motor;

(c) said cam motor (d) said tilt motor (e) said raising and lowering motor;

(f) said idler motor;

(g) said rack motor; or (h) any combination of the above.

6. The apparatus of claim 1, in which:

at least one PLC controls either:

(a) said frame motor;

(b) said cam motor;

(c) said tilt motor;

(d) said raising and lowering motor;

(e) said idler motor; or (f) any combination of the above.

* * * * *